US006575170B1

(12) United States Patent
Prasad

(10) Patent No.: US 6,575,170 B1
(45) Date of Patent: Jun. 10, 2003

(54) METHOD AND APPARATUS FOR EXPANDING TOBACCO MATERIAL

(76) Inventor: Ravi Prasad, 2600 St. Regis Dr., Richmond, VA (US) 23236

( * ) Notice: Subject to any disclaimer, the term of this patent is extended or adjusted under 35 U.S.C. 154(b) by 80 days.

(21) Appl. No.: 09/721,696

(22) Filed: Nov. 27, 2000

(51) Int. Cl.[7] ..... A24B 3/18
(52) U.S. Cl. ..... 131/309; 131/310
(58) Field of Search ..... 131/291, 296, 131/300, 900, 290, 293, 302, 306, 309, 310, 303; 426/49, 445, 447, 577

(56) References Cited

U.S. PATENT DOCUMENTS

| | | | | | |
|---|---|---|---|---|---|
| 3,529,606 | A | * | 9/1970 | de la burde et al. | 131/296 |
| 3,575,178 | A | * | 4/1971 | Stewart | 131/296 |
| 3,683,937 | A | * | 8/1972 | Fredrickson et al. | 131/294 |
| 4,235,250 | A | | 11/1980 | Utsch | |
| 4,253,474 | A | | 3/1981 | Hibbitts et al. | |
| 4,258,729 | A | | 3/1981 | de la Burde et al. | |
| 4,333,483 | A | | 6/1982 | de la Burde et al. | |
| 4,336,814 | A | | 6/1982 | Sykes et al. | |
| 4,340,073 | A | | 7/1982 | de la Burde et al. | |
| 4,531,529 | A | * | 7/1985 | White et al. | 131/291 |
| 4,554,932 | A | * | 11/1985 | Conrad et al. | 131/290 |
| 4,630,619 | A | | 12/1986 | Korte et al. | |
| 4,946,697 | A | | 8/1990 | Payne | |
| 5,012,826 | A | * | 5/1991 | Kramer | 131/291 |
| 5,020,550 | A | | 6/1991 | Uchiyama et al. | |
| 5,065,774 | A | * | 11/1991 | Grubbs et al. | 131/291 |
| 5,076,293 | A | * | 12/1991 | Kramer | 131/291 |
| 5,095,923 | A | * | 3/1992 | Kramer | 131/290 |
| 5,143,096 | A | * | 9/1992 | Steinberg | 131/291 |
| 5,251,649 | A | | 10/1993 | Cho et al. | |
| 5,311,885 | A | * | 5/1994 | Yoshimoto et al. | 131/900 |
| 5,483,977 | A | * | 1/1996 | Conrad et al. | 131/291 |
| 5,647,382 | A | * | 7/1997 | Lovette et al. | 131/291 |
| 5,653,245 | A | * | 8/1997 | Beard et al. | 122/35 |
| 5,799,665 | A | * | 9/1998 | Cho et al. | 131/291 |
| 6,158,441 | A | * | 12/2000 | Grigutsch et al. | 131/296 |
| 6,254,902 | B1 | * | 7/2001 | Hodges et al. | 426/445 |

FOREIGN PATENT DOCUMENTS

| | | | | |
|---|---|---|---|---|
| WO | WO 87/07478 | * | 12/1987 | A24B/3/18 |

* cited by examiner

*Primary Examiner*—Steven P. Griffin
*Assistant Examiner*—Carlos Lopez

(57) ABSTRACT

A process for exapanding tobacco employs gaseous impregnant at elevated pressure. Tobacco is passed through a gaseous impregnant atmosphere using mechanical devices (e.g., pressure locks, pocket feeders). Tobacco gets impregnated with pressurized gaseous impregnant during the "pass-through". Uniformity of impregnation is obtained by passing small batches of tobacco having uniform bulk density, and uniform gas properties at or near the tobacco exit point of the "Pass-through". Natural buoyancy of the impregnant gas assures that gas temperature uniformity is achieved quickly and without any elaborate control system, and in a simplified, self controlling and self regulating process. Significant equipment cost and size reduction results. An apparatus that uses the improved process is also provided. For carbon dioxide impregnated tobacco, expansion occurs when the impregnated tobacco is subjected to conditions that cause rapid release of the impregnated gas. Rapid heating of propane impregnated tobacco is not required for the expansion of tobacco.

24 Claims, 6 Drawing Sheets

METHOD AND APPARATUS FOR EXPANDING TOBACCO MATERIAL

FIELD OF INVENTION

The present invention relates to a process and an apparatus for expanding materials of an agricultural origin, and more particularly, to a process and an apparatus for expanding tobacco material.

BACKGROUND OF THE INVENTION

Tobacco is an agricultural material that is cultivated and harvested. During the prior art curing process, the harvested tobacco experiences a loss in moisture and shrinks (i.e. reduction in weight and volume). If the cured tobacco material of reduced volume is used to manufacture cigarettes, the amount of tobacco material per cigarette must be increased, thereby increasing the tar and nicotine level of the cigarette.

The tobacco prior art has long recognized the desirability of expanding the tobacco to make up this loss in volume. With the increase in market share of low tar and nicotine delivery cigarettes, it has become even more important to expand the tobacco. The expanded tobacco reduces the weight of tobacco in a cigarette rod and results in lower tar & nicotine delivery to the consumer.

Cho et al. (U.S. Pat. No. 5,251,649, hereafter "Cho"), the contents of which is incorporated herein by reference, describes a method for expanding the volume of tobacco to compensate for the loss in volume caused in curing of the tobacco leaf. The process of Cho employs saturated carbon dioxide gas in combination with a controlled amount of liquid carbon dioxide. Tobacco is filled into a pressure vessel at a high packing density and then pressurized with carbon dioxide. This prior art process of Cho involves pre-cooling the tobacco to a lower temperature, which causes the condensation of a controlled amount of liquid carbon dioxide.

De la Burde et al. (U.S. Pat. No. 4,258,729, hereafter "de la Burde"), the contents of which is incorporated herein by reference, describes a method for expanding the volume of tobacco. De la Burde fills the tobacco into an impregnation vessel prior to pressurization with carbon dioxide that remains substantially in the gaseous state. Pre-cooling the tobacco prior to the impregnation step or cooling the tobacco bed by external means during impregnation is limited to avoid condensing the carbon dioxide to any significant degree.

Utsch (U.S. Pat. No. 4,235,250), the contents of which is incorporated herein by reference, describes a method for expanding the volume of tobacco in which the tobacco is filled into an impregnation vessel prior to pressurization with carbon dioxide in the gaseous state. During the pressure release, some of the gaseous carbon dioxide is converted to a partially condensed state within the tobacco. The process employs steps for controlling the enthalpy of carbon dioxide in such a manner as to minimize the carbon dioxide condensation during the pressure release.

Uchiyama et al. (U.S. Pat. No. 5,020,550, hereafter "Uchiyama"), the contents of which is incorporated herein by reference, employs a mechanically complex means of conveying tobacco and carbon dioxide to an impregnation vessel. Carbon dioxide is conveyed to the impregnation vessel with booster/de-booster mechanisms, and tobacco is conveyed with screw conveyors from intermediate pressure preparatory vessels. Tobacco movement within the impregnation vessel is controlled with another screw conveyor. Uchiyama uses cooling jackets to control the carbon dioxide temperature, and liquid carbon dioxide formation is considered to offer a process advantage.

However, the various prior art methods and apparatuses discussed above have various problems and disadvantages. For example, the above-discussed prior art processes for tobacco impregnation involve the time consuming steps of transporting tobacco into a pressure vessel prior to the pressurization with the gaseous impregnant, or the pumping in of the liquid impregnant. As a result, the prior art batch size of tobacco is large, resulting in non-uniform bulk density of the tobacco bed (i.e., higher bulk density of tobacco at the bottom). The impregnant gas properties are also non-uniform in the prior art, as hot spots form during the pressurization step, due to the heat of compression. The result is non-uniform impregnation of tobacco.

Further, the prior art describes various methods for achieving uniformity of tobacco impregnation by either over impregnating the tobacco to a higher level of carbon dioxide pick-up or by removing the hot spots via extended flow of gas followed by condensation of a controlled amount of carbon dioxide. These additional steps result in lower process efficiency, extended cycle time and increased cost. The extended cycle time requires the tobacco batch size to be large, resulting in even more non-uniform bulk density of the tobacco bed.

SUMMARY OF THE INVENTION

It is an object of the present invention to overcome the disadvantages and problems of the prior art.

It is another object of the present invention to reduce tobacco batch size while maintaining production capacity, and generate an impregnated tobacco product having uniform bulk density.

It is a further object of the present invention to overcome the prior art problems of non-uniform impregnation of tobacco, including the formation of hot spots during pressurization.

It is still another object of the present invention to produce a process and apparatus for impregnating a target material at a higher process efficiency, lowered time cycle and reduced cost, due to the elimination of the prior art pre-cooling requirement.

It is yet another object of the present invention to minimize the amount of impregnant used and thus, produce an environmentally advantageous process and apparatus.

It is still another object of the present invention to produce a simple, self-controlling, self-regulating and rapid process that takes advantage of the natural buoyancy of pressurized gas.

To achieve the objects of the present invention, there is provided a process for expanding a target material, comprising the steps of providing a pressure vessel containing gaseous impregnant at an elevated pressure, impregnating said target material by passing said target material through the pressurized impregnant gas, and subjecting said impregnated target material to conditions such that said target material is expanded.

A method of impregnating tobacco is also provided, comprising the steps of receiving said tobacco in a first vessel that is not pressurized, purging and pressurizing said first vessel containing said tobacco, and passing said pressurized tobacco through a pressurized vessel that comprises a pressurized impregnant gas a pressurized impregnant liquid, wherein said pressurized tobacco passes through a pipe that permits exchange with said impregnant gas. The method further comprises passing said impregnant gas through said pipe to generate a uniform density of pressurized gas substantially at a saturation condition, wherein the second passing step uniformly equilibrates/cools said tobacco, depressurizing/cooling said passed tobacco in a second vessel, and discharging said cooled/depressurized tobacco from said second vessel, wherein said receiving and discharging steps are conducted simultaneously.

To further achieve the above-mentioned objects, there is provided an apparatus for impregnating a target material, comprising a target material introduction system that receives said target material, alters a first state characteristic of said target material, and positions said target material for output to a pressurized vessel, said pressurized vessel being configured to receive and process said target material via a gravity-fall process, wherein a pressurized medium maintains a substantially uniform density in said pressurized vessel, and a target material discharge system that receives and alters a first state characteristic and a second state characteristic of said processed target material.

Another apparatus for impregnating a tobacco material is provided, comprising a first pocket feeder that receives, pressurizes and positions said tobacco material for output to a pressurized vessel, said pressurized vessel being configured to receive and process said tobacco material via a gravity-fall process, wherein a pressurized gas maintains a substantially uniform density in said pressurized vessel. According to this apparatus, said pressurized vessel comprises a tube connected between an output of said tobacco material introduction system and said tobacco material discharge system, and a pressure control system that maintains a substantially constant pressure and temperature in said pressurized vessel, said pressure control system comprising a first control device that receives, compresses and cools said pressurized gas from said pressurized vessel, a control processor that receives and bubbles said compressed, cooled pressurized gas through a pressurized control container that contains a liquid impregnant, and a return system that transports said bubbled pressurized gas to said pressurized vessel. This apparatus also comprises a second pocket feeder that receives and alters said pressure and a temperature of said processed tobacco material.

Yet another apparatus for impregnating a tobacco material is provided, comprising a first pocket feeder that receives, pressurizes and positions said tobacco material for output to a pressurized vessel, said pressurized vessel being configured to receive and process said tobacco material via a gravity-fall process, wherein a pressurized gas and a pressurized liquid maintain a substantially uniform density in said pressurized vessel, wherein said pressurized liquid provides a self-regulating and self-controlling process for said apparatus. The pressurized vessel of this apparatus comprises a tube connected between an output of said tobacco material introduction system and said tobacco material discharge system, said tube further comprising a dam that prevents entry of a liquid impregnant from said pressurized vessel into said tube and made of one of a screen type material and a porous material, and a gas recovery system that maintains a substantially constant pressure and temperature in said pressurized vessel, said gas recovery system comprising a return system that transports and bubbles said pressurized gas to said pressurized vessel. The apparatus also comprises a second pocket feeder that receives and alters said pressure and a temperature of said processed tobacco material.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

DETAILED DESCRIPTION OF THE INVENTION

Reference will now be made to the preferred embodiments of the present invention, examples of which are illustrated in the accompanying drawings. The present invention encompasses an improved process for the expansion of tobacco using gaseous impregnant at elevated pressure and an apparatus for carrying out the process.

The improved process involves providing a pressure vessel pre-pressurized to an elevated level with an impregnant such as carbon dioxide, propane or other gases (e.g., ethane, isobutane, n-butane). The pre-pressurized impregnant may be all gas, or preferably, it may be a combination of gas & liquid in the pressure vessel. However, only the gas comes in contact with the tobacco.

The tobacco is caused to contact the impregnant as it passes through the pre-pressurized impregnant in the pressure vessel. Mechanical pressure locks or pocket feeders are used to effect a "quick" passage of tobacco through the gaseous carbon dioxide or propane. Tobacco passage is effected via a smooth inner tube that connects the top feeder to the bottom feeder. In the first and second embodiments of the present invention, the inner tube is made up, at least in part, of a screen that allows free flow of gasses while keeping the tobacco particles inside the tube. At the exit point of the passage of tobacco, the impregnant in contact with the tobacco is close to its saturation conditions. The natural tendency of buoyancy of gasses, (hot gasses tend to rise as colder gases tend to fall), results in uniform gaseous impregnant, at or close to its saturation condition, being present at the exit point (low point) of the tobacco passage. The uniformity of gaseous impregnant in the bottom pocket (at close to its saturation condition), occurs simultaneously with the gravity fall of tobacco from the top feeder to the bottom feeder. Upon rapid venting of the bottom pocket the tobacco is uniformly cooled and impregnated.

No extra time or elaborate controls are needed to achieve the desired uniformity of impregnant gas in the bottom pocket. The result is lower cost, uniform product and very short cycle times. The impregnated tobacco is then subjected to known expansion conditions, (i.e., in case of carbon dioxide it is subjected to rapid heating at atmospheric pressure).

The apparatus for carrying out the process of this invention involves a pressure vessel containing pre-pressurized impregnant gas. Preferably, liquid impregnant is also present in the pressure vessel, as it makes the process self regulating and self controlling.

Figure 1:
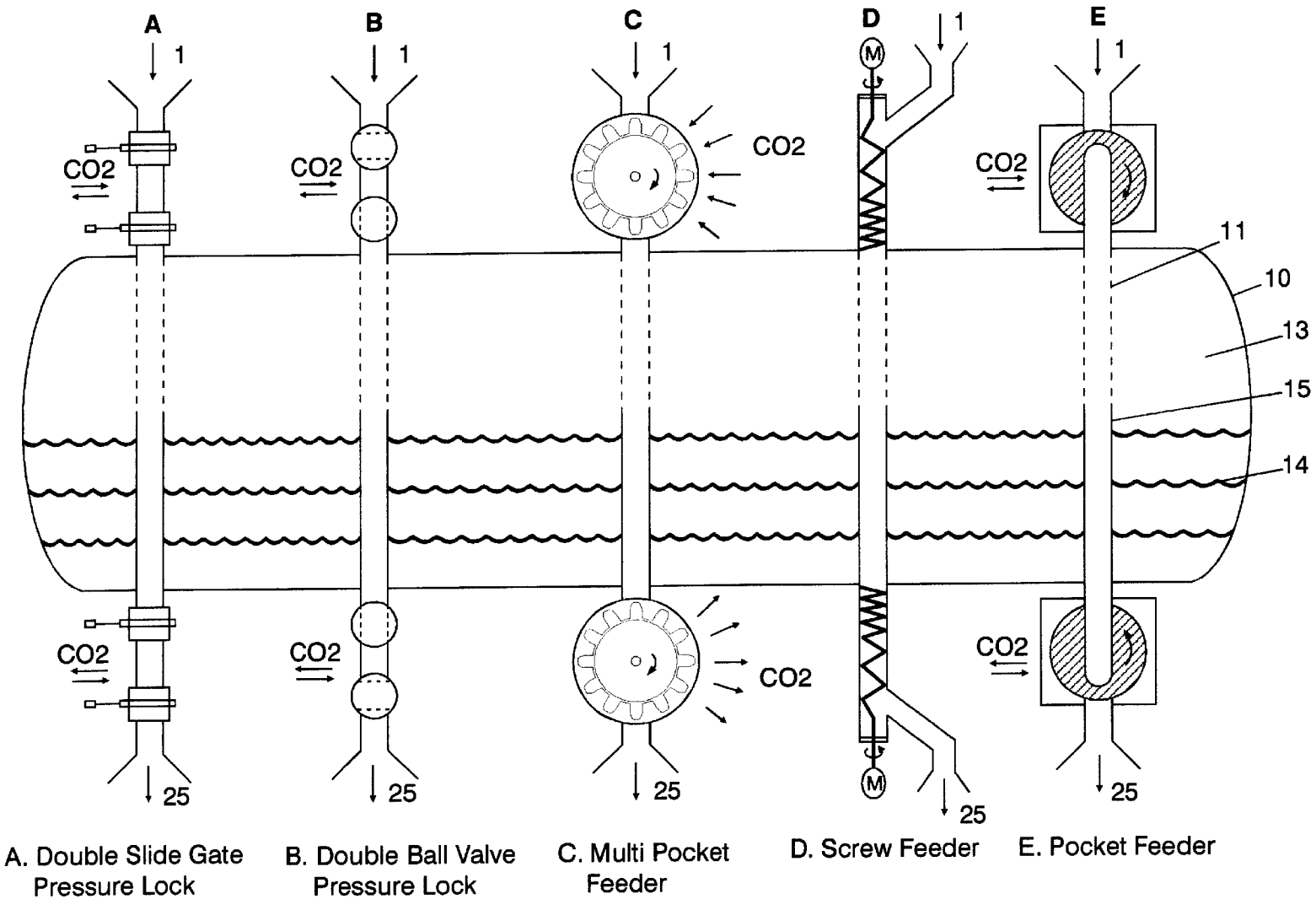
FIG. 1 illustrates various devices for passing tobacco through a vessel for expanding tobacco material according to a first preferred embodiment of the present invention.

FIG. 1 illustrates various types of pressure locks and/or feeders that maybe used for the pressurization and passage of tobacco through a pressure vessel containing gaseous impregnant at an elevated pressure, according to the first and second preferred embodiments of the present invention. It is noted that while FIG. 1 illustrates the first preferred embodiment of the present invention, the pressure locks and/or feeders may be used in the first and second embodiments of the present invention. The tobacco drops via gravity from the top pressure lock to the bottom pressure lock and gets impregnated in the process.

More specifically, FIG. 1 illustrates a horizontal pressure vessel 10, containing gaseous impregnant 13 and liquid impregnant 14, at an elevated pressure. To facilitate the passage of tobacco through the pre-pressurized gaseous impregnant, various commercially available pressure locks or pocket feeders A, B, C, D, E are shown in FIG. 1 at the top and at the bottom of the pressure vessel.

For example, Option A illustrates a double slide gate used as pressure lock, Option B illustrates double ball valves used as pressure lock, Option C illustrates a multi-pocket feeder used to transfer tobacco into and out of the gaseous impregnant at elevated pressure, Option D illustrates a screw feeder or extruder, and Option E illustrates a single pocket feeder. While any of the above-mentioned types of pressure locks and/or feeders may be used, Option E (i.e., using a single pocket feeder) is preferred in the present invention.

Choice of the correct feeder depends on various size, cost and mechanical design considerations. The design options A, B, D, E involve the entry of tobacco 1 at the top feeder, followed by pressurization of the top and bottom feeders. Tobacco drops by gravity from the top feeder via the inner tube into the bottom feeder. The bottom feeder goes through pressure release and impregnated tobacco drops out at the bottom 25.

The pressure locks are connected via a smooth inner tube made up of a solid part 15 and a porous or screen part 11. In the first embodiment of the present invention, the solid part 15 is included, while the second preferred embodiment of the present invention does not include the solid part 15. The screen part 11 of the inner tube allows free flow of the pre-pressurized gas while confining tobacco particles to within the tube. The solid part 15 of the inner tube acts as a dam for the liquid and keeps the liquid from contacting the tobacco.

Figure 2:
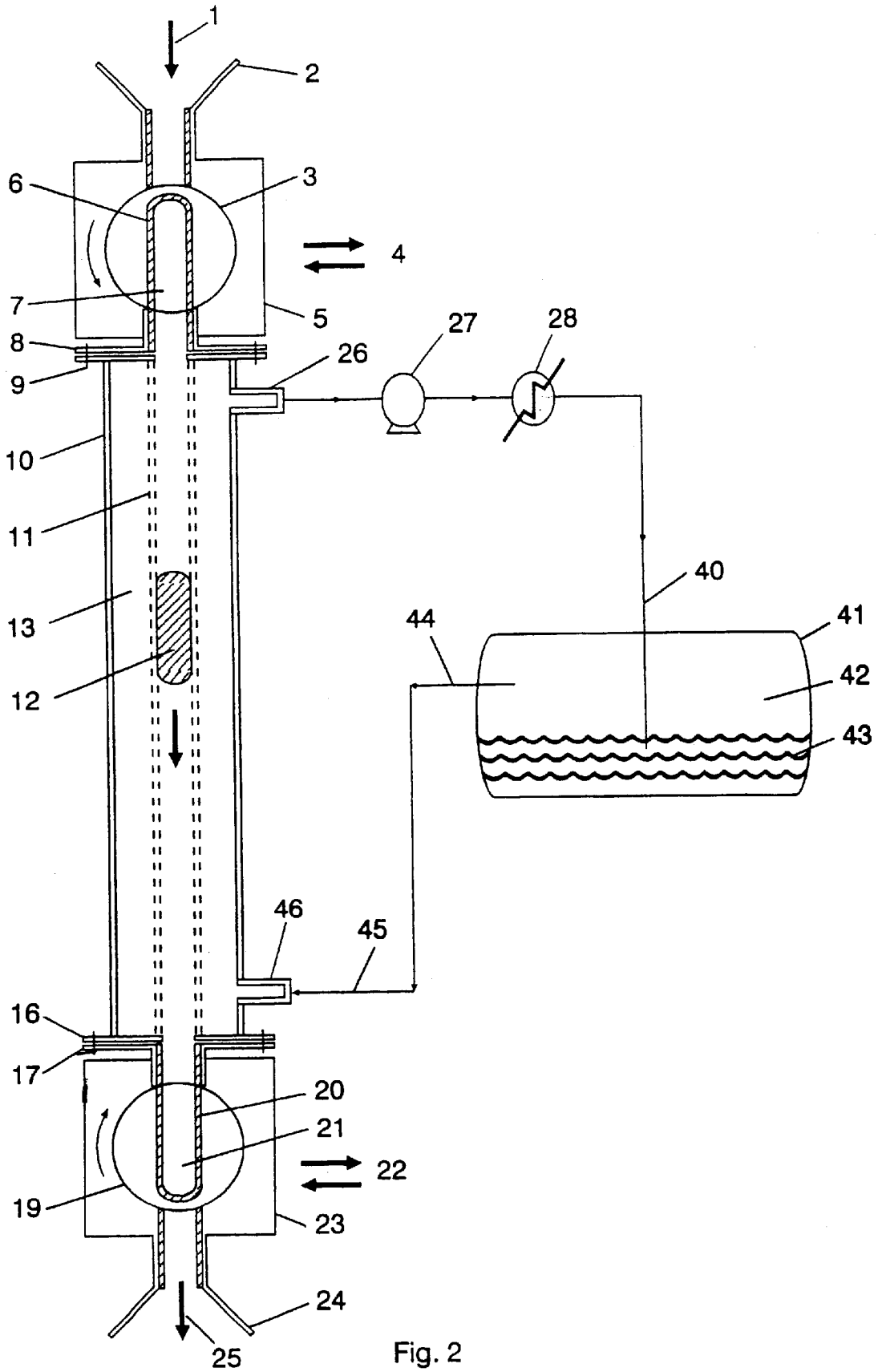
FIG. 2 illustrates an apparatus for expanding tobacco material according to a second preferred embodiment of the present invention.

FIG. 2 illustrates the second preferred embodiment of the present invention, wherein only gaseous impregnant is present in the pressure vessel. To control the uniformity of gas conditions, gas is made to flow across the pressure vessel. The tobacco drops, via gravity, through the pressure vessel from the top pocket feeder to the bottom pocket feeder, and gets impregnated in the process.

More specifically, FIG. 2 illustrates an apparatus to carry out the second preferred embodiment of the present invention using an all screen inner tube 11 connected to a top pocket feeder 5 and a bottom pocket feeder 23. The pressure vessel 10 is pre-pressurized with an impregnant gas 13 without the presence of any liquid. Tobacco enters the top feeder 1, guided by the top funnel 2, filling the pocket 7 of the top pocket feeder 5. Flanges 8, 16, secured by bolts 9, 17, connect the respective top and bottom pocket feeders 5, 23 to the pressure vessel 10. The feeders 3, 19 rotate and are pressurized by the impregnant 4, 22 to a pressure equal to the vessel 13. The feeders then rotate again, and tobacco 12 drops via the inner tube 11 from the top pocket 7 to the bottom pocket 21. The feeders 3, 19 rotate for pressure release of the impregnant gas 4, 22, followed by rotation to drop impregnated tobacco 25, guided by the bottom inverted funnel 24.

Due to the absence of liquid, the control of gaseous impregnant is effected by the circulation of gas from port 26 via compressor 27 and cooler 28, as illustrated in FIG. 2. The impregnant is bubbled in a first line 40 into a pressurized container 41 and through liquid impregnant 43 having a gaseous impregnant 42 present, to reach saturation conditions at a second line 44, and it returns to the vessel at 46, via a third line 45. The circulation of saturated impregnant gas assures the uniformity of tobacco impregnation in the bottom pocket 21. Both the pockets are insulated 6, 20 to avoid any metal cold spots from liquefying the impregnant gas. The cold spots are not detrimental to the process, but may cause over impregnation of tobacco. The insulation avoids over impregnation of tobacco and makes the process more environmentally friendly.

Figure 3:
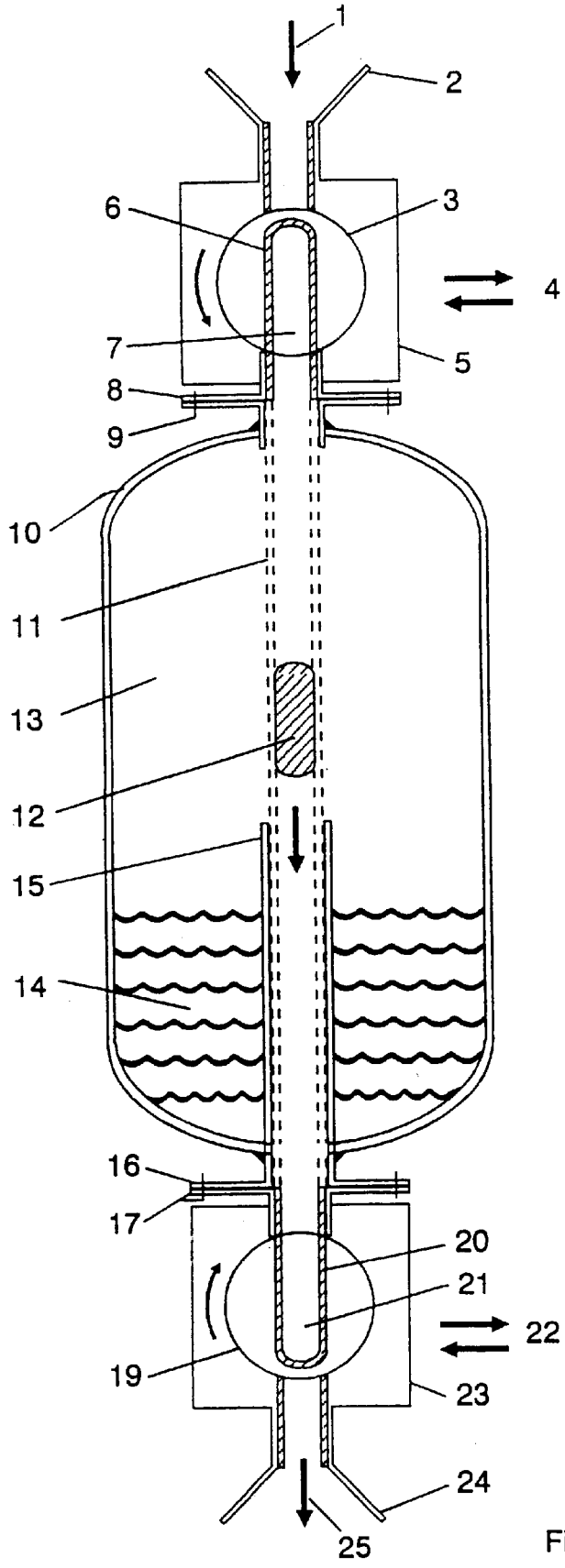
FIG. 3 illustrates the apparatus for expanding tobacco material according to the first preferred embodiment of the present invention.

FIG. 3 illustrates the first preferred embodiment of the present invention in which the pressurized impregnant is present in both the liquid and the gaseous state. Tobacco comes in contact with gaseous impregnant as it drops by gravity from the top pocket feeder to the bottom pocket feeder. A vertical pressure vessel 10 equipped with pocket feeders at the top 5 and at the bottom 23. Both pockets 7, 21 are insulated 6, 20 to avoid condensation and over impregnation conditions from taking place. Pre-pressurized impregnant gas 13 and impregnant liquid 14 are both present in the pressure vessel 10.

A smooth inner tube made up of screen 11 connects the top 7 and the bottom 21 pockets to facilitate the gravity drop of tobacco 12. Both pockets rotate to 90 degree position for pressurization and for pressure release 4, 22 to facilitate the passage of tobacco through the pre-pressurized impregnant gas. A solid pipe 15 connected to the bottom flange 16 extends above the liquid in the vessel 10 and acts as a dam to keep the liquid from contacting the tobacco.

As the tobacco 12 drops into the bottom pocket 21, the gaseous hot spots in the bottom pocket naturally and simultaneously rise out of the pocket 21, as illustrated in FIG. 3. This occurs almost as fast as the tobacco fills the bottom pocket. The higher density saturated gas just above the liquid surface 14, moves down inside the solid pipe 15 behind the screen inner tube 11 to replace the hot gas moving upward. This easy, natural path connecting the saturated gas to the bottom pocket makes the process self regulating and self controlling. The tobacco batch is kept relatively small or about 13.9 pounds for 20 second cycle. The tobacco bulk density of the small batch of tobacco remains uniform in contact with the impregnant gas. The impregnant gas in the bottom pocket is held close to its saturation condition. Upon pressure release, uniformly impregnated and cooled tobacco is obtained even with very short cycle times.

Figure 4:
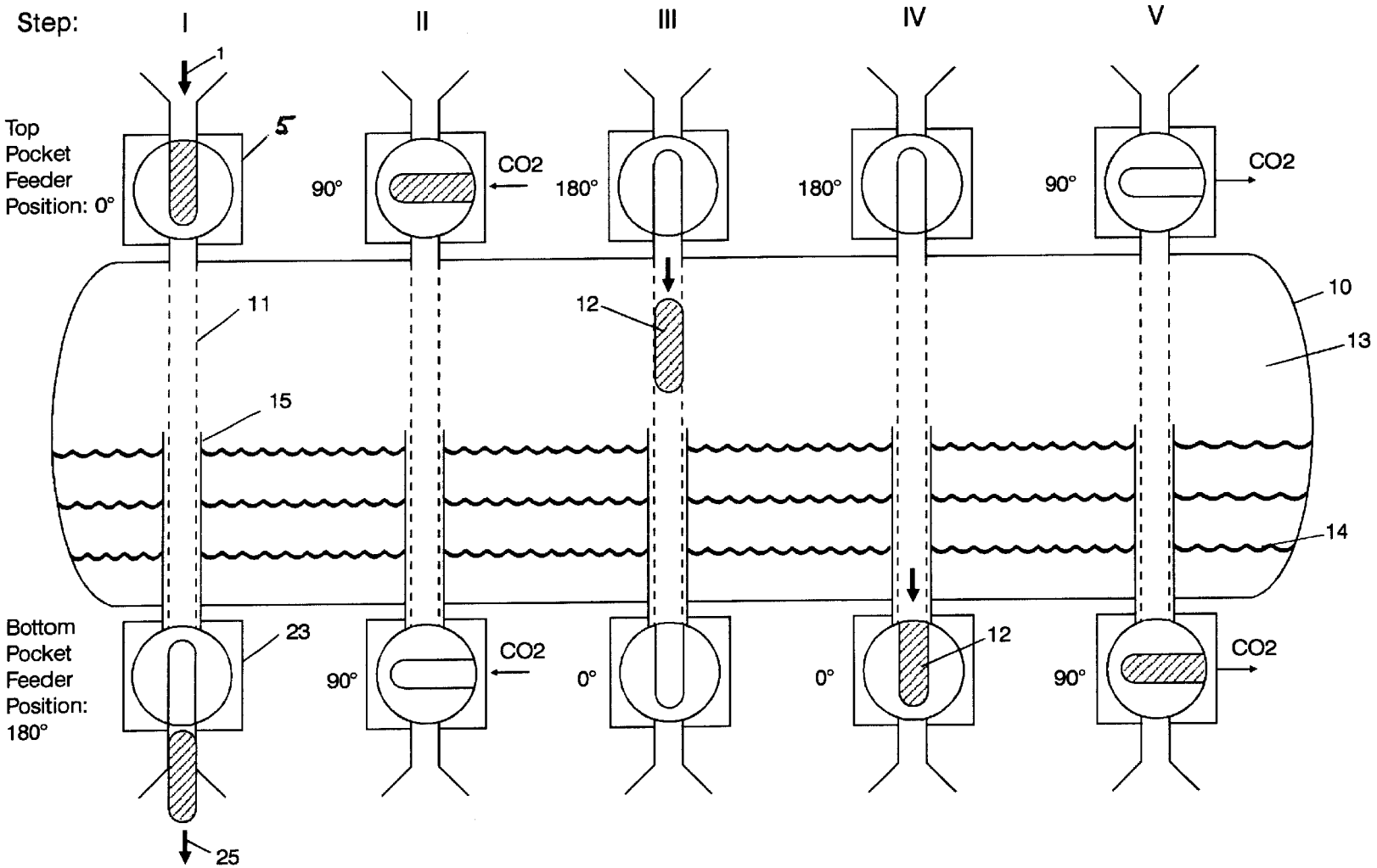
FIG. 4 illustrates a method for expanding tobacco material according to the first embodiment of the present invention.

FIG. 4 illustrates a method for the first preferred embodiment of the present invention, as illustrated in FIG. 3. The five steps of the top and bottom pocket feeders are depicted for clearer understanding of the process. The movement of tobacco through the pressurized gaseous impregnant is shown in greater detail.

In the present method, the pressure vessel 10 is pre-pressurized with the impregnant gas 13 and liquid 14. The top pocket feeder 5 is connected to the bottom pocket feeder 23 with a screen tube 11. A solid pipe 15 acts as a dam to keep the liquid from contacting the tobacco. The annular gap between the solid pipe 15 and the inner screen tube 11 is provided for the quick displacement of the hot gases rising out of the bottom pocket 21 with cooler saturated impregnant gas. The flow of tobacco and the operation of the pocket feeders are shown in FIG. 4 in five steps.

In the first step I, the top and bottom pocket feeders are at atmospheric pressure in a position to introduce the fresh tobacco at the top 1 and to discharge the impregnated tobacco from the bottom 25. The screen tube 11 is empty of tobacco and contains the impregnant gas at an elevated pressure equal to the pressure in vessel 13. The first step I (to load the fresh tobacco and to unload the impregnated tobacco) requires approximately. 3 seconds.

In the second step II, both pockets rotate to 90-degree position to be pressurized with the gaseous impregnant. A purge sequence is carried out prior to pressurization. The purge and pressurization steps are discussed in greater detail below. The second step II requires approximately 7 seconds.

In the third step III, both pockets rotate to cause the gravity-fall of tobacco 12 from the top pocket, down through the connecting tube, into the bottom pocket. The third step III requires approximately 3 seconds.

In the fourth step IV, the turbulence caused by tobacco falling into the bottom pocket 12 and the natural tendency of hot gases to rise, results in achieving a uniform density of pressurized gas close to its saturation condition in the bottom pocket. The annular space between the solid outer tube and the screen inner tube is designed for the rushing-in of cooler gases into the bottom pocket to quickly replace the hot gases rising out of the bottom pocket. The fourth step IV requires approximately 1 second.

In the fifth step V, both pockets rotate to 90-degree position for pressure release and the recovery of the impregnant gas. The pressure in the pockets is rapidly reduced to atmospheric pressure. Details of the pressure increase and release steps II, V are discussed in greater detail below. The tobacco in the bottom pocket is uniformly impregnated and cooled during the pressure release, The fifth step V requires approximately 6 seconds.

After the fifth step V, the first step I is repeated, as the pockets rotate to discharge impregnated tobacco and to introduce a fresh batch of tobacco.

The above-described five step process is repeated approximately every 20 seconds to produce about 2,500 pounds/hour of impregnated tobacco. The time for each step indicated above is only an estimate. If the cycle time was actually shorter, for example approximately 10 seconds, the production level will increase to about 5,000 pounds/hour of tobacco. To maximize production, the cycle time should be kept as short as possible.

Figure 5:
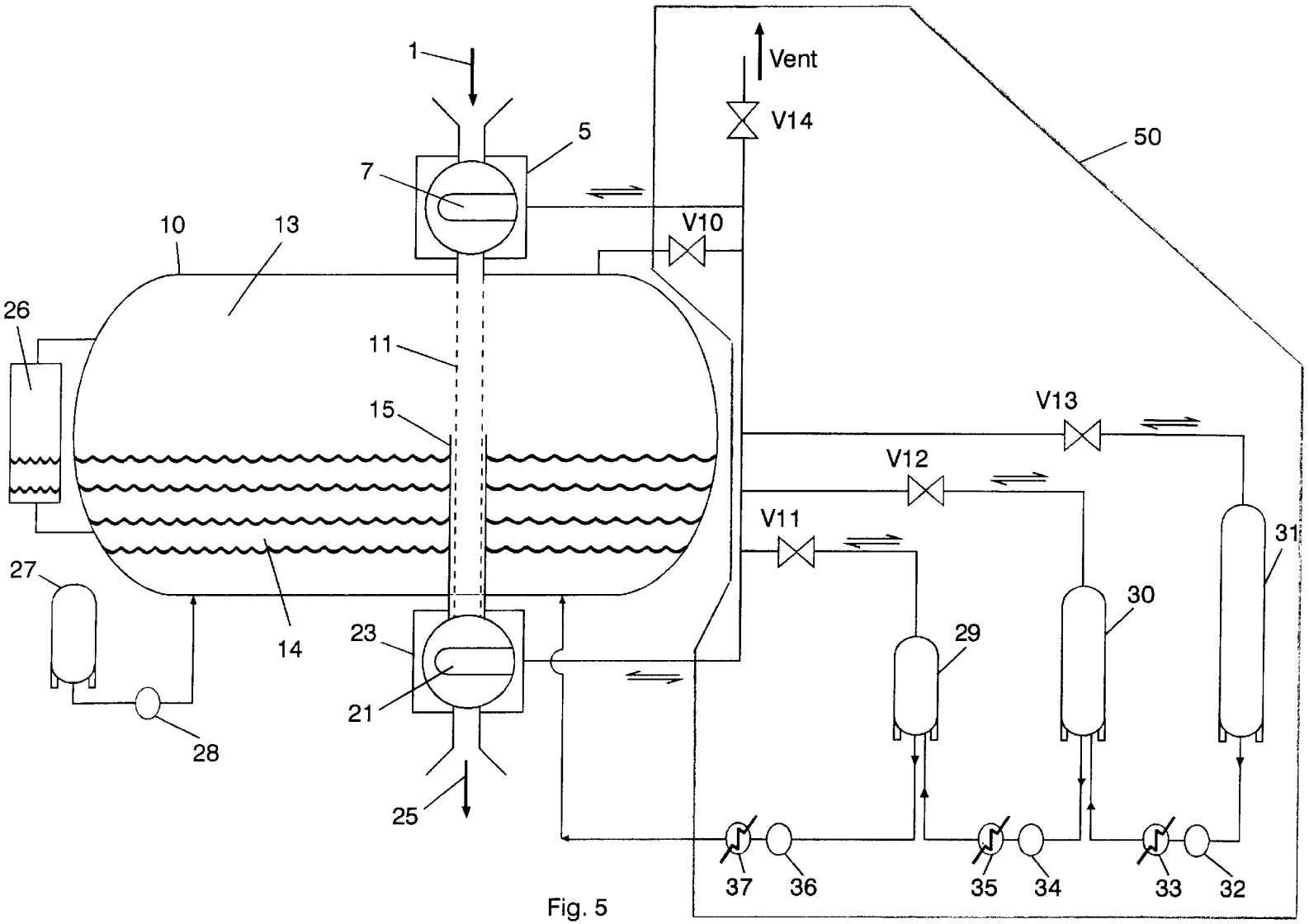
FIG. 5 illustrates a method and apparatus for purging and pressuring the top and bottom pocket feeders according to the first preferred embodiment of the present invention.

FIG. 5 illustrates the first preferred embodiment of the present invention, as illustrated in FIGS. 3, 4 in greater detail. A purge and pressurization system 50 includes pressure tanks and valves for impregnant pressurization & recovery (i.e., purge). For the first preferred embodiment of the present invention, carbon dioxide is chosen as the impregnant at a pressure of about 850 psig (or 865 psia or pounds per square inch absolute). However, other impregnants such as propane can be chosen at its optimal pressure and temperature in a similar fashion.

A horizontal pressure vessel 10 is shown in FIG. 5. It is pre-pressurized with liquid carbon dioxide 14 and gaseous carbon dioxide 13 to a pressure of about 865 psia. A sight glass 26 indicates the level of liquid in the vessel and carbon dioxide makeup pump 28 is provided to pump additional liquid carbon dioxide from storage tank 27, to maintain the target liquid level in the vessel. The passage of tobacco through the gaseous carbon dioxide at elevated pressure is done with a pair of pocket feeders 5, 23 connected with a screen tube 11 and a solid pipe 15. The pockets 7, 21 are illustrated in 90-degree position for purge & pressurization. Three gas recovery tanks 29, 30, 31 with carbon dioxide gas at a pressure of about 320 psia, 119 psia and 44 psia are connected to the pockets with valves (V11, V12, V13).

The purge step is needed to remove any air in the pockets. First, valve V13 is opened to pressurize the pockets with carbon dioxide to about 44 psia. Then, valve V13 is closed and valve V14 is opened to remove most of the air from the pockets.

Next, a pressurization step with carbon dioxide is accomplished by opening and closing valves V13, V12, V11, V10 in quick succession. Then, the pockets rotate to drop the tobacco from the top pocket, through the screen tube, and into the bottom pocket. The hot spots formed due to the heat of compression during pressurization, rise quickly out of the bottom pocket as cooler gas rushes in to replace it. The annular space between the solid outer tube and the screen inner tube is designed for the rushing-in of cooler gases into the bottom pocket to quickly replace the hot gases rising out of the bottom pocket.

The pockets rotate again to 90-degree position for the pressure release and for the recovery of carbon dioxide gas from the pockets. This is done by opening and closing valves V11, V12, V13, V14 in quick succession. The pockets rotate again to discharge the impregnated tobacco from the bottom and to introduce a fresh batch of tobacco at the top. Compressors 32, 34, 36 and coolers 33, 35, 37 are provided to pump lower pressure carbon dioxide gas to higher pressure vessels. The methodology described above is an essential part of obtaining very short cycle times and making the process work. It is an advantage of the present invention that pressurization and depressurization/recovery of gas is accomplished in short order with the open/shut movement of valves alone, thus substantially eliminating the need for operation of compressors or pumps for evacuation of the pressure chamber, as described in the prior art incorporated herein by reference.

Generally, the tobacco to be impregnated will have a moisture content of at least about 11% and less than about 21%, although tobacco having higher or lower moisture content maybe impregnated using this process. Preferably, the tobacco to be impregnated is at about 12% to 15% moisture.

The present invention may be used to impregnate and expand tobacco of various types and in many forms, including tobacco in cut or chopped form, tobacco stems or reconstituted tobacco. Preferably, cured leaf tobacco or tobacco stem, cut to a particle size suitable for direct inclusion into a cigarette rod, is used.

A tobacco bulk density of as low as about 3 pounds/cubic foot and as high as about 8 pounds/cubic foot may be impregnated using the present invention. Preferably, the natural bulk density of tobacco, as it is normally handled in the factory on conveyor belts etc., of about 5 pounds per cubic foot is used. High tobacco bulk densities result in insufficient cooling upon pressure release of impregnant gas. High tobacco bulk density obtained with compacting tobacco gives problems with the smooth passage of tobacco as it drops through the screen tube connecting the top and bottom pockets. It may also cause the impregnation to be non-uniform due to the higher tobacco density at the bottom of the bed compared to the tobacco density at the top of the bed.

The impregnant gas may be chosen from a variety of known gases used in the prior art to expand the tobacco. Carbon dioxide gas is the preferred impregnant because it is relatively inexpensive, non-combustible and non-toxic. Carbon dioxide may be used in gas form or super critical form. Carbon dioxide gas may be used in the presence or absence of liquid carbon dioxide. Preferably, carbon dioxide is used in gas form in the presence of liquid carbon dioxide as it assures the gas to be at or close to its saturation condition. Use of gas in the presence of liquid carbon dioxide also makes the process self controlling and allows the operation at very short cycle times. The impregnated tobacco is then heated rapidly at atmospheric conditions to expand the tobacco.

Propane gas in presence of liquid propane is used to impregnate tobacco in a very similar fashion as carbon dioxide as illustrated in FIGS. 4 and 5. Due to the flammable nature of propane, additional safety precautions are required during the impregnation and the gas recovery steps. The advantage of using propane as an impregnant is that the heating step to expand the tobacco after impregnation is not needed.

The screen tube used for tobacco passage from the top pocket feeder to the bottom is made of a very smooth surface. For example, standard Vee-Wire design with a very small slot opening is preferred. Alternatively, an inner tube made of sintered or porous metal (having a pore size of approximately 20 micron or larger) is used for the passage of tobacco through the gaseous impregnant.

The pocket feeder is a standard design with cylindrical shaped pockets of a uniform internal diameter, as shown in FIGS. 2 and 3. The insulation insert is made up of a plastic material acceptable for use with tobacco. For example, an insert of high density polyethylene can be machined to fit the pocket and it can be held inside the pocket with a cement or with recessed screws. In order to assure the release or drop of tobacco from the pocket, the insert can be tapered at about two degrees outward angle, giving a wider opening at the outer edge than at the base of the pocket.

Figure 6:
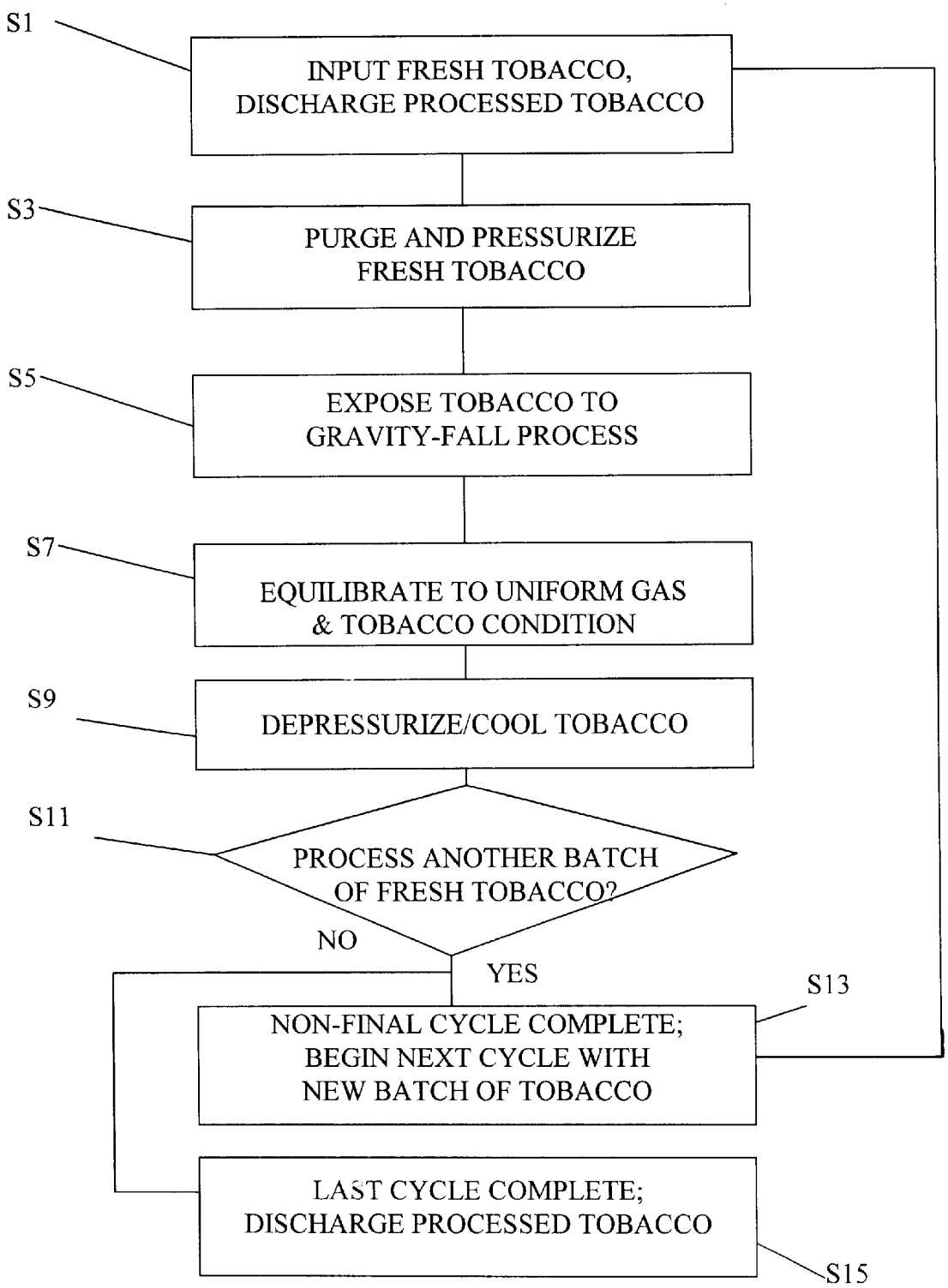
FIG. 6 illustrates a method of expanding tobacco according to the first or second preferred embodiment of the present invention.

FIG. 6 illustrates a method of impregnating tobacco according to the first and second preferred embodiments of the present invention. In a first step S1, a batch of fresh tobacco or other not yet processed agricultural material is input into a processing system. If the processing system has received a previous input batch of fresh tobacco, a batch of processed tobacco or other processed agricultural material is simultaneously discharged in the first step S1.

In a second step S3, the input batch of tobacco is exposed to a purge and pressurization process, wherein any air is removed from the tobacco, and the tobacco is exposed to a high pressure level. The purging process is accomplished by exposing the fresh batch of tobacco to a high pressure level and then remove air from the fresh batch of tobacco. The pressurization process is accomplished by a series of pressurization steps at increasing pressure levels, wherein carbon dioxide (or other suitable gas) is applied.

In a third step S5, the purged, pressurized batch of tobacco is exposed to a gravity-fall process, wherein the tobacco is exposed to a pressurized medium. However, the tobacco is collected after it has been exposed to the gravity-fall process, such that substantially all of the tobacco is removed from the pressurized medium in the pressure vessel.

In a fourth step S7, the collected batch of tobacco is equilibrated and cooled due to the natural buoyancy of warmer gases, to produce a uniform density of pressurized gas close to its saturation condition. In the first preferred embodiment of the present invention, a liquid impregnant is also used in the pressurized medium to create a self-regulating and self-controlling process.

In a fifth step S9, the tobacco is depressurized by a series of sequential depressurizations, wherein a gas is depressurized to a lower pressure than the previous pressure in order to reduce the pressure of the tobacco to a prescribed level. By this step S9, the tobacco is uniformly impregnated and substantially cooled. At this point, a full cycle has been completed.

In a sixth step S11, a decision is required as to whether processing of tobacco has been completed, or whether another fresh batch of tobacco is to be processed. If another fresh batch of tobacco is to be processed, then in another step S13, a next cycle of the process begins, and another fresh batch of tobacco is loaded in the first step S1, and the cycle repeats.

If the processing has been completed, yet another step S15 occurs, wherein the cooled, impregnated tobacco in unloaded, and no fresh batch of tobacco is loaded. At this point, the last cycle has been completed.

EXAMPLE 1

Two 24 inch pocket feeders 5, 23, as illustrated in FIG. 5, are equipped with insulation liners and connected with a tube 11 for the passage of tobacco through the pressure vessel 10. The vessel is filled partially with liquid carbon dioxide and heated until the pressure reaches about 865 psia. Bright tobacco filler, cut at about 21% moisture and dried to about 14% moisture, is used for the expansion trials. Several batches of tobacco are pre weighed at about 13.9 pounds each, having a moisture content of about 14%.

The following steps outline the impregnation process of Example 1:

(a) Rotate pockets, introduce the first 13.9 pounds batch of tobacco into the top pocket. (about 3 seconds)

(b) Rotate pockets, pressurize both pockets with carbon dioxide gas to about 865 psia. (about 7 seconds)

(c) Rotate pockets, drop the tobacco from top pocket through the connecting tube to the bottom pocket. (about 4 seconds)

(d) Rotate pockets, de-pressurize both pockets and recover the carbon dioxide gas as described above. (about 6 seconds)

(e) Rotate pockets, remove impregnated tobacco from the bottom pocket and send it for expansion via rapid heating at atmospheric pressure. At the same time, introduce the next 13.9 pounds batch of tobacco into the top pocket.

(f) Repeat steps 1 through 5 above to expand 13.9 pounds of tobacco about every 20 seconds, or about 2,500 pounds per hour of expanded tobacco.

EXAMPLE 2

Two 24 inch pocket feeders of example 1 are used to expand tobacco. The vessel 10 illustrated in FIG. 5 is filled partially with liquid propane and heated until the pressure reaches about 565 psia. Bright tobacco filler cut at about 21% moisture and dried to about 14% moisture is used for the expansion trials. As the expansion with propane occurs during de-pressurization, the pocket is only half loaded to allow room for expansion. Several batches of tobacco are pre weighed at about 7 pounds each, having a moisture content of about 14%.

The following steps outline the impregnation process according to Example 2:

(a) Rotate pockets, introduce the first 7 pounds batch of tobacco into the top pocket. (about 3 seconds)

(b) Rotate pockets, pressurize both pockets with propane gas to about 565 psia. (about 7 seconds)

(c) Rotate pockets, drop the tobacco from top pocket through the connecting tube to the bottom pocket. (about 4 seconds)

(d) Rotate pockets, de-pressurize both pockets and recover the propane gas as described in Example 1. (about 6 seconds)

(e) Rotate pockets, remove impregnated and expanded tobacco from the bottom pocket. At the same time, introduce the next 7 pounds batch of tobacco into the top pocket.

(f) Repeat steps 1 through 5 above to expand about 7 pounds of tobacco about every 20 seconds, or about 1,260 pounds per hour of expanded tobacco.

The present invention has various advantages. For example, tobacco impregnated according to the preferred embodiments of the present invention is processed more quickly and efficiently than all known prior art. The increase in process efficiency obtained with the methodology of this invention significantly reduces both the size of the equipment required and the complexity of the equipment.

Also, a significant reduction in the size and the cost of equipment results. For example, short cycle times allow small batches of tobacco to be processed while maintaining the same production capacity. For example, at a typical tobacco cut filler bulk density of five pounds, per cubic feet, the full scale production capacity target of 5,000 pounds/hour of tobacco will require 1,000 cubic feet/hour of tobacco volume to be moved through the pre-pressurized impregnant in the pressure vessel. A cycle time of 12 minutes will require the pocket feeder to be about 200 cubic feet in volume processing 1,000 pounds/batch of tobacco. Reducing the cycle time to 10 seconds will require the pocket feeder to be only 2.78 cubic feet in volume, processing about 13.9 pounds/batch of tobacco. Therefore, the target production capacity of 5,000 pounds/hour of tobacco can be met with a pair of pocket feeders about 20 inches in diameter and 16 inches deep.

Further, processing of small batches of tobacco has an additional advantage, in that, the bulk density of each batch of tobacco is more uniform. In the bottom pocket feeder, both the pre-pressurized gaseous impregnant and the tobacco are at very uniform densities just prior to the release of pressure. This improves the uniformity of impregnation even further. In prior art, over impregnation is often used to compensate for the lack of uniformity of tobacco impregnation. This invention makes over impregnation of tobacco unnecessary and it makes the process more environmentally friendly.

Additionally, the cycle time to process a batch of tobacco is reduced significantly as pre-cooling of tobacco is not required. Additional flow of carbon dioxide gas to remove the heat of compression described in the prior art is not required in the methodology of the present invention, as the gaseous hot spots are removed simultaneously with the passage of tobacco. The natural buoyancy of pressurized gas causes the removal of the hot spots from the bottom pocket feeder. Cooler gas, at or close to its saturation level, is heavier (higher density) than the hot gases rising from the bottom pocket. The design of the process takes advantage of this property and facilitates the rushing in of cooler gases to replace the hot gases in the pocket. This occurs simultaneously with the gravity drop of tobacco into the bottom pocket, and without the use of additional equipment or time. Thus, the resulting process becomes simple, self controlling, self regulating and very quick.

Further, the shortness of cycle time allows the tobacco batch size to remain very small giving an even more uniform tobacco product. The process minimizes the amount of impregnant used and therefore, it is environmentally friendly.

It will be apparent to those skilled in the art that various modifications and variations can be made in the method of the present invention without departing from the spirit or scope of the invention. Thus, it is intended that the present invention cover the modifications and variations of this invention provided they come within the scope of the appended claims and their equivalents. For example, the present invention need not be limited to the expansion of tobacco, but can be used to expand other agricultural materials as well.

I claim:

1. A process for expanding a target tobacco material, comprising the steps of:

a. providing a pressure vessel containing gaseous impregnant at an elevated pressure;

b. impregnanting said target material by passing said target material via a gravity drop through the gaseous impregnant; wherein said passing of said target material through the gaseous impregnant comprises said gravity drop of said target material from a target material introduction device to a target material discharge device; and c. subjecting said impregnated target material to conditions such that said target material is expanded.

2. The process of claim 1, wherein the pressure vessel contains both gas and liquid impregnant, said providing step further comprising providing an impregnant liquid at an elevated pressure in said pressure vessel.

3. The process of claim 2 wherein the impregnant gas and the impregnant liquid provided to the pressure vessel in said providing step are carbon dioxide at a pressure between 350 psig and 1057 psig.

4. The process of claim 2 wherein the impregnant gas and said impregnant liquid provided to the pressure vessel in said providing step are propane at a pressure between 250 psig and 632 psig.

5. The process of claim 2, wherein the impregnant gas and the impregnant liquid provided to the pressure vessel in said providing step are carbon dioxide at a pressure between 800 psig and 1000 psig.

6. The process of claim 1 wherein the impregnant gas contained in said pressure vessel of said providing step is carbon dioxide.

7. The process of claim 1 wherein the impregnant gas is carbon dioxide at a pressure above 1057 psig, and a temperature above 88 degrees F., at supercritical conditions.

8. The process of claim 1 wherein said target material introduction device is selected from a group consisting of a double slide gate, a double ball valve arrangement, a screw feeder, an extruder device, a multiple pocket feeder device and a pocket feeder.

9. The process of claim 1 wherein the passing of said target material through a pressurized atmosphere of the impregnant gas is accomplished with simultaneous replacement of hot impregnant gas with cooler saturated impregnant gas, due to forces of nature buoyancy of hot impregnant gas trapped within a bottom pocket of the pressure vessel.

10. The process of claim 1 wherein the impregnant gas is super critical propane at a temperature above 207 degrees F. and a pressure above 632 psig.

11. The process of claim 1 wherein the impregnant gas is selected from one of carbon dioxide, propane, ethane, n-butane and isobutane.

12. The process of claim 1, wherein said target material comprises tobacco.

13. The process of claim 1, wherein said target material comprises tobacco that has been provided with additional cooling to a lower temperature, in order to assure an adequate level of impregnation, at tobacco bulk density above 6 pounds per cubic feet.

14. The process of claim 1, further comprising a step of pressuring said target material prior to said impregnation step, said pressuring step comprising:

placing said target material in a first vessel used as an introduction device;

purging air from said first vessel;

pressurizing said target material in said first vessel to a pressure level substantially equal to said elevated pressure level of said pressure vessel;

and exposing said target material to said pressure vessel.

15. The process of claim 1, wherein said target material comprises tobacco at a moisture of 11% to 21%.

16. The process of claim 15, wherein said moisture content is between 12% and 15%.

17. The process of claim 1, where said target material comprises tobacco at the bulk density of 3 to 8 pounds per cubic feet, prior to said impregnating.

18. The process of claim 17, wherein said bulk density is 4 to 6 pounds per cubic feet.

19. The process of claim 1, wherein said gravity drop of said target material is through a confining tube allowing contact with the pressurized impregnant gas.

20. The process of claim 19, said gravity drop of said target material is through a smooth inner confining tube comprising a screen material that allows free exchange/flow of impregnant gas while keeping the falling target material within the tube.

21. The process of claim 20, wherein the inner tube for passing said target material is enclosed in an outer solid pipe such that the annular space between the tube and the outer solid pipe facilitates quick flow of heavier saturated impregnant gas into a bottom pocket.

22. The process of claim 21 wherein said inner tube is a screen tube.

23. The process of claim 21 wherein said inner tube comprises porous metal designed for minimum resistance to the flow of said impregnant gas while restricting a path of the target material during the gravity drop to remain within the tube.

24. A method of impregnating tobacco, comprising:

receiving said tobacco in a first vessel is not pressurized;

purging and pressurizing said first vessel containing said tobacco;

(a) passing said pressurized tobacco through a pressurized vessel that comprises a pressurized impregnant gas and a pressurized impregnant liquid, wherein said pressurized tobacco passes through a pipe that permits exchange with said impregnant gas, (b) equilibrating said impregnant gas to generate a uniform density of pressurized gas substantially at a saturation condition, wherein step (b), upon depressurization, uniformly cools said tobacco;

depressurizing said passed tobacco in a second vessel; and discharging said depressurized tobacco from said second vessel, wherein said receiving and discharging steps are conducted simultaneously.

* * * * *